US007834832B2

(12) United States Patent
Ha

(10) Patent No.: US 7,834,832 B2
(45) Date of Patent: Nov. 16, 2010

(54) DISPLAY DEVICE AND METHOD OF DRIVING THE SAME

(75) Inventor: Woo-Suk Ha, Yongin-si (KR)

(73) Assignee: LG Displau Co., Ltd., Seoul (KR)

( * ) Notice: Subject to any disclaimer, the term of this patent is extended or adjusted under 35 U.S.C. 154(b) by 1128 days.

(21) Appl. No.: 11/476,644

(22) Filed: Jun. 29, 2006

(65) Prior Publication Data

US 2007/0046567 A1 Mar. 1, 2007

(30) Foreign Application Priority Data

Aug. 26, 2005 (KR) ..... 10-2005-0078865

(51) Int. Cl.
*G09G 3/36* (2006.01)

(52) U.S. Cl. ..... 345/87; 345/38

(58) Field of Classification Search ..... 345/38, 345/87, 89, 90, 92, 95, 98–100
See application file for complete search history.

(56) References Cited

U.S. PATENT DOCUMENTS

| | | | | |
|---|---|---|---|---|
| 5,940,055 | A * | 8/1999 | Lee | 345/87 |
| 5,952,989 | A * | 9/1999 | Koyama | 345/92 |
| 6,075,505 | A * | 6/2000 | Shiba et al. | 345/87 |
| 7,084,849 | B2 * | 8/2006 | Noguchi et al. | 345/96 |
| 7,206,048 | B2 * | 4/2007 | Song | 349/129 |
| 7,557,785 | B2 * | 7/2009 | Kim | 345/87 |
| 2004/0257147 | A1 * | 12/2004 | Jeoung et al. | 327/427 |
| 2004/0263745 | A1 * | 12/2004 | Lee et al. | 349/139 |
| 2005/0156857 | A1 * | 7/2005 | Lee et al. | 345/100 |
| 2006/0043366 | A1 * | 3/2006 | Ha et al. | 257/59 |
| 2006/0066512 | A1 * | 3/2006 | Afentakis et al. | 345/55 |
| 2006/0164363 | A1 * | 7/2006 | Battersby et al. | 345/98 |
| 2007/0057890 | A1 * | 3/2007 | Ayel et al. | 345/94 |
| 2009/0174829 | A1 * | 7/2009 | Shin et al. | 349/37 |

FOREIGN PATENT DOCUMENTS

| | | |
|---|---|---|
| CN | 1482593 | 3/2004 |
| JP | 11-84417 A | 3/1999 |
| JP | 2004-62146 A | 2/2004 |

* cited by examiner

*Primary Examiner*—Ricardo L Osorio
(74) *Attorney, Agent, or Firm*—Birch, Stewart, Kolasch & Birch LLP

(57) ABSTRACT

A liquid crystal display device according to an embodiment includes a plurality of data lines and a plurality of gate lines crossing each other; a first pixel connected to one of the plurality of data lines and one of the plurality of gate lines; and a second pixel connected to the one of the plurality of data lines and to the one of the plurality of gate lines, wherein the first and second pixels are disposed at opposite sides with respect to the one of the plurality of data lines and at opposite sides with respect to the one of the plurality of gate lines.

19 Claims, 4 Drawing Sheets

DISPLAY DEVICE AND METHOD OF DRIVING THE SAME

The present invention claims the priority benefit of Korean Patent Application No. 10-2005-078865, filed in Korea on Aug. 26, 2005, which is hereby incorporated by reference.

BACKGROUND OF THE INVENTION

1. Field of the Invention

The present invention relates to a liquid crystal display device, and more particularly, to a liquid crystal display device and a method of driving the same.

2. Discussion of the Related Art

Until recently, display devices have typically used cathode-ray tubes (CRTs). Presently, much effort is being expended to study and develop various types of flat panel displays, such as liquid crystal display (LCD) devices, plasma display panels (PDPs), field emission displays (FED), and electro-luminescence displays (ELDs), as a substitute for CRTs. In particular, these types of flat panel displays have been driven in an active matrix type display in which a plurality of pixels arranged in a matrix form are driven using a plurality of thin film transistors therein. Among the active matrix types of flat panel displays, liquid crystal display (LCD) devices and electroluminescent display (ELD) devices are widely used as monitors for notebook computers and desktop computers because of their high resolution, ability to display colors and superiority in displaying moving images.

In general, an LCD device includes two substrates that are spaced apart and face each other with a liquid crystal material interposed between the two substrates. The two substrates include electrodes that face each other such that a voltage applied between the electrodes induces an electric field across the liquid crystal material. Alignment of the liquid crystal molecules in the liquid crystal material changes in accordance with the intensity of the induced electric field in the direction of the induced electric field, thereby changing the light transmissivity of the LCD device. Thus, the LCD device displays images by varying the intensity of the induced electric field.

Recently, a vertical alignment (VA) mode LCD device is used to achieve a wide viewing angle.

FIG. 1 is a circuit diagram of a VA mode LCD device according to the related art, and FIG. 2 is a waveform view of a common voltage and a storage voltage supplied to a pixel of the LCD device of FIG. 1.

As shown in FIG. 1, the related art LCD device includes a plurality of gate lines G(n−1) to G(n+1) that are extended along a first direction, and a plurality of data lines D(m−1) to D(m+1) that are extended along a second direction and crossing the gate lines.

A plurality of pixels are arranged in a matrix form. Each pixel is connected to the corresponding one of the gate lines G(n−1) to G(n+1) and the corresponding one of the data lines D(m−1) to D(m+1). Each pixel includes a thin film transistor TFT, a liquid crystal capacitor Clc and a storage capacitor Cst. One electrode of the liquid crystal capacitor Clc is connected to the thin film transistor TFT, and the other electrode of the liquid crystal capacitor Clc is supplied with a common voltage Vcom. One electrode of the storage capacitor Cst is connected to the thin film transistor TFT, and the other electrode of the storage capacitor Cst is supplied with a storage voltage Vst. The storage voltage Vst determines an amount of a voltage stored in the pixel.

The related art LCD device is driven in a method wherein two pixels arranged adjacent along one of the data lines D(m−1) to D(m+1) and connected to the same one of the gate lines G(n−1) to G(n+1), as shown with a dashed box in FIG. 1, are supplied with the same data voltage. The two pixels supplied with the same data voltage constitute a pixel unit PXL.

Referring to FIG. 2, a DC (direct current) common voltage Vcom and an AC (alternating current) storage voltage Vst are supplied to each pixel. The storage voltage Vst has a specific frequency and alternates with respect to the common voltage Vcom. A waveform of the storage voltage Vst supplied to one pixel of the pixel unit PXL is opposite to a waveform of the storage voltage Vst supplied to the other pixel of the pixel unit PXL.

Since the storage voltages Vst having the different phase are supplied to the two pixels of the pixel unit PXL, the two pixels have different voltages stored. Accordingly, in the two pixels supplied with the same data voltage, a rotational angle difference of liquid crystal molecules is generated. By this difference, a viewing angle of the LCD device is improved.

However, the related art LCD device has some problems. A storage line, which transfers the storage voltage and is formed at the same step of forming the data line or the gate line, has a resistance load and a capacitance load. Such loads of the storage line cause a drop in the storage voltage along the storage line path. In particular, since the storage voltage has an AC waveform, the storage voltage drop appears remarkably. Accordingly, the storage voltage desired is not supplied to the pixel as the pixel gets closer to the end of the storage line. Therefore, improvement of the viewing angle is reduced and a display quality is degraded.

SUMMARY OF THE INVENTION

The present invention provides a liquid crystal display device and a method of driving the liquid crystal display device, which address the limitations and problems associated with the related art.

By way of introduction only, in one aspect of the present invention, a liquid crystal display device includes a plurality of data lines and a plurality of gate lines crossing each other; a first pixel connected to one of the plurality of data lines and one of the plurality of gate lines, the first pixel supplied with a common voltage and a first storage voltage; and a second pixel connected to said one of the plurality of data lines and said one of the plurality of gate lines, the second pixel supplied with the common voltage and a second storage voltage, wherein the first and second pixels are disposed at opposite sides with respect to said one of the plurality of data lines and opposite sides with respect to said one of the plurality of gate lines.

In another aspect, the present invention provides a method of driving a liquid crystal display device including sequentially supplying an on gate voltage to a plurality of gate lines; supplying a plurality of data voltages to a plurality of data lines, respectively; and supplying first and second storage voltages to first and second pixels, respectively, and supplying a common voltage to the first and second pixels, the first and second storage voltages being DC voltages, wherein the first pixel is connected to one of the plurality of data lines and one of the plurality of gate lines, and the second pixel connected to said one of the plurality of data lines and said one of the plurality of gate lines.

In another aspect, the present invention provides a liquid crystal display device including a plurality of data lines and a plurality of gate lines crossing each other; a first pixel connected to one of the plurality of data lines and one of the plurality of gate lines, the first pixel supplied with a common voltage and a first storage voltage; and a second pixel connected to said one of the plurality of data lines and said one of the plurality of gate lines, the second pixel supplied with the common voltage and a second storage voltage, wherein the common voltage and the first and second storage voltage are DC voltages.

According to another aspect, the present invention provides a liquid crystal display device, comprising: a plurality of data lines and a plurality of gate lines crossing each other; a first pixel connected to one of the plurality of data lines and to one of the plurality of gate lines; and a second pixel connected to said one of the plurality of data lines and to said one of the plurality of gate lines, wherein the first and second pixels are disposed at opposite sides with respect to said one of the plurality of data lines and at opposite sides with respect to said one of the plurality of gate lines.

According to another aspect, the present invention provides a method for forming a liquid crystal display device, comprising: forming a plurality of data lines and a plurality of gate lines crossing each other on a substrate; forming a first pixel connected to one of the plurality of data lines and to one of the plurality of gate lines; and forming a second pixel connected to said one of the plurality of data lines and to said one of the plurality of gate lines, wherein the first and second pixels are disposed at opposite sides with respect to said one of the plurality of data lines and at opposite sides with respect to said one of the plurality of gate lines.

According to another aspect, the present invention provides a method of driving a liquid crystal display device, comprising: sequentially supplying an on gate voltage to a plurality of gate lines; supplying a plurality of data voltages to a plurality of data lines, respectively; supplying first and second storage voltages to first and second pixels, respectively, the first and second storage voltages being DC voltages; and supplying a common voltage to the first and second pixels.

According to another aspect, the present invention provides a liquid crystal display device, comprising: a plurality of data lines and a plurality of gate lines crossing each other, and at least two pixels provided at each region defined by two adjacent data lines crossing two adjacent gate lines, each of the pixels including a storage capacitor, wherein each of the pixels is supplied with a common voltage, each of the storage capacitors is supplied with a first or second storage voltage, and the common voltage and the first and second storage voltages are DC voltages.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE PREFERRED EMBODIMENTS

Reference will now be made in detail to the illustrated embodiments of the present invention, which are illustrated in the accompanying drawings.

Figure 1:
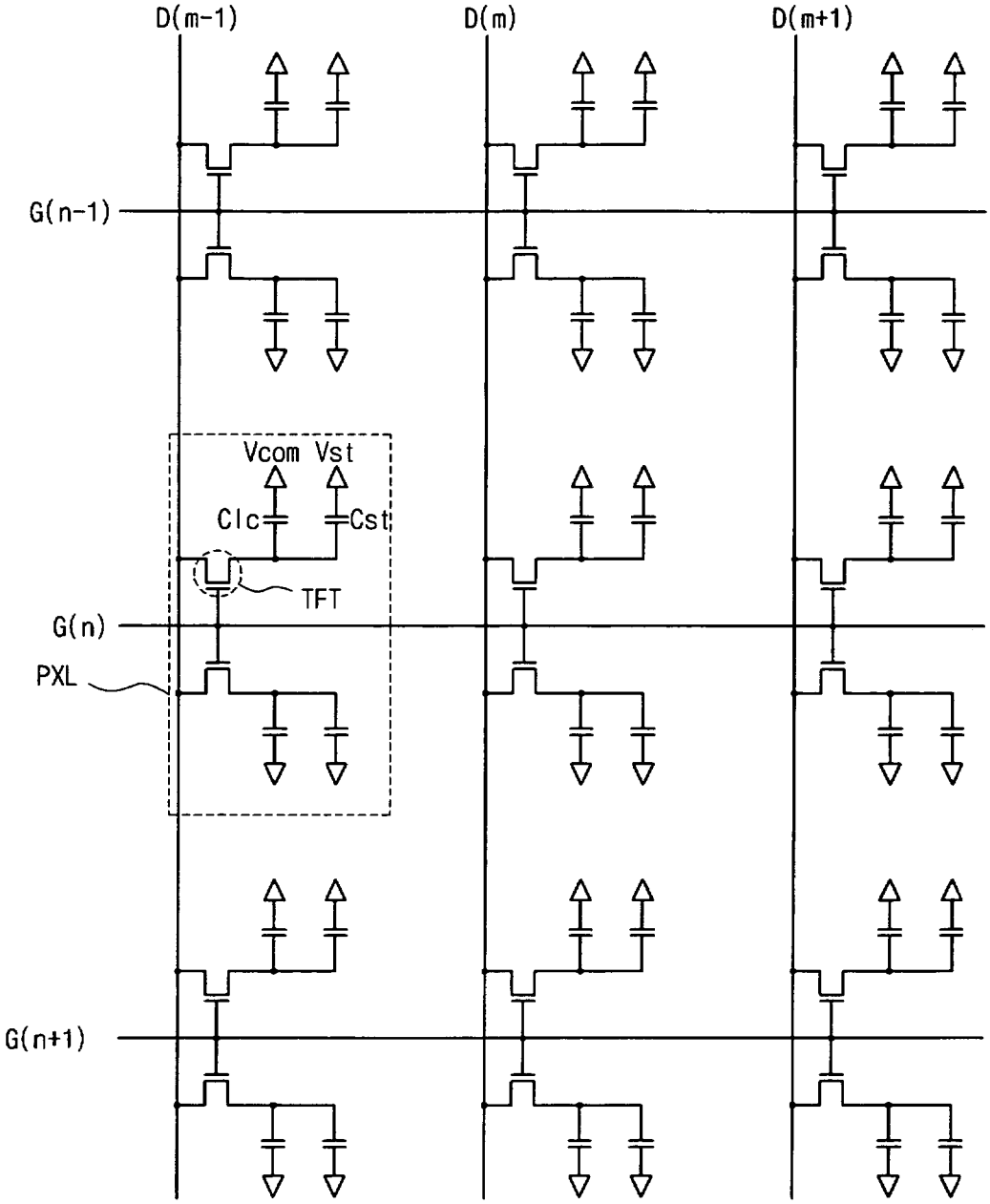
FIG. 1 RELATED ART
FIG. 1 is a circuit diagram of a VA mode LCD device according to the related art.
Figure 2:
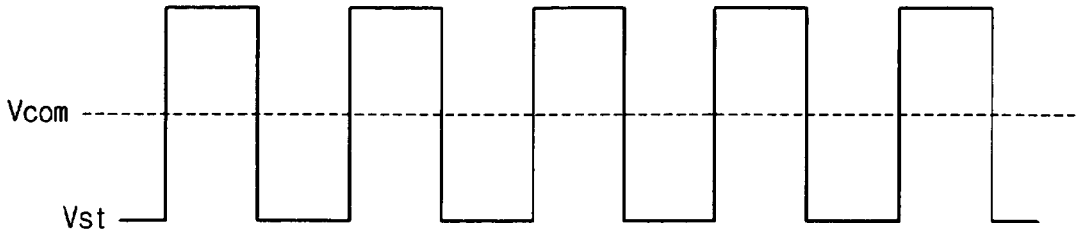
FIG. 2 RELATED ART
FIG. 2 is a waveform view of a common voltage and a storage voltage supplied to a pixel of the LCD device of FIG. 1
Figure 3:
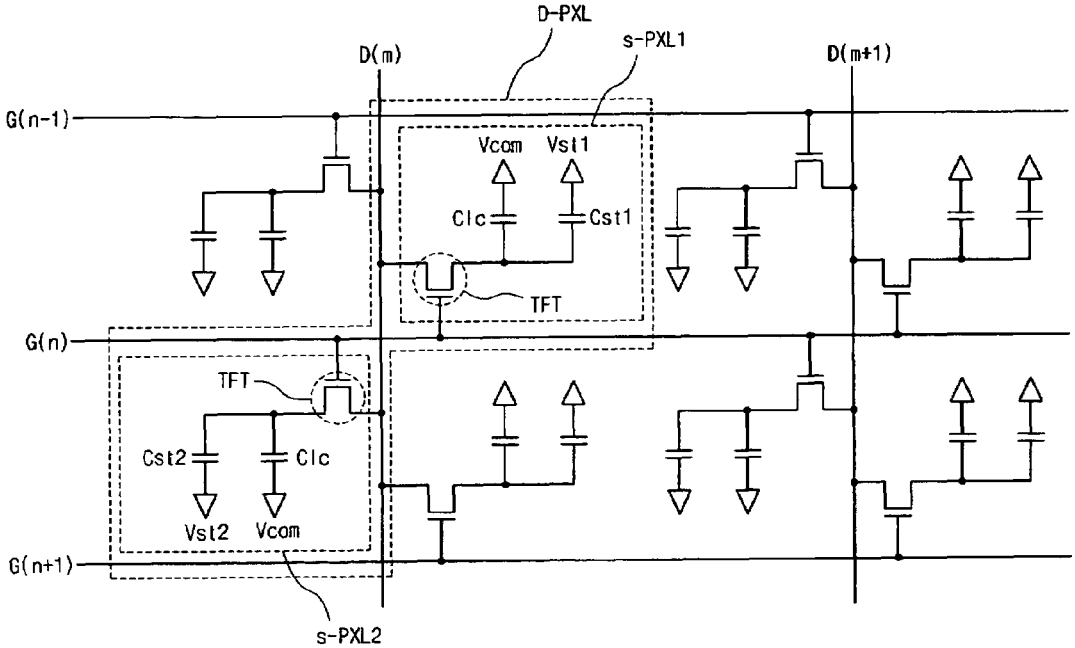
FIG. 3 is a circuit diagram of a VA mode LCD device according to an embodiment of the present invention
Figure 4:
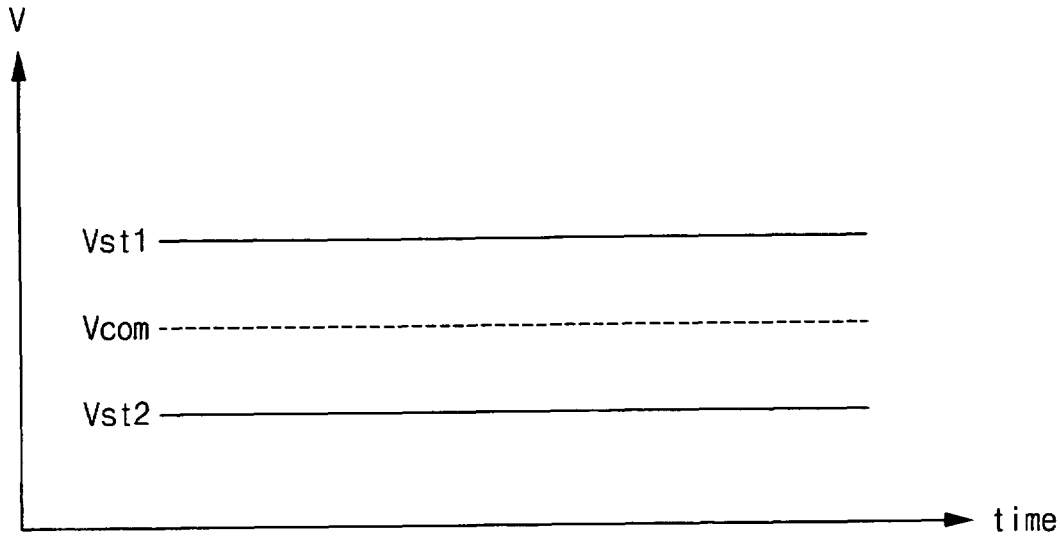
FIG. 4 is a waveform view of a common voltage and a storage voltage supplied to a pixel of the LCD device of FIG. 3.

FIG. 3 is a circuit diagram of a VA mode LCD device according to an embodiment of the present invention, and FIG. 4 is an example of a waveform view of a common voltage and a storage voltage supplied to a pixel of the LCD device of FIG. 3 according to the present invention.

As shown in FIG. 3, the LCD device includes a plurality of gate lines G(n−1) to G(n+1) extended along a first direction and a plurality of data lines D(m) and D(m+1) extended along a second direction and crossing the gate lines. The first and second directions are perpendicular or substantially perpendicular to each other. The plurality of gate lines G(n−1) to G(n+1) and the plurality of data lines D(m) to D(m+1) define a plurality of pixel regions. Although not shown in the drawings, the LCD device includes known components including, but limited to, first and second substrates and a liquid crystal layer between the first and second substrates. The plurality of gate lines G(n−1) to G(n+1) and the plurality of data lines D(m) and D(m+1) are disposed on the first substrate.

A plurality of pixels are arranged in a matrix form, and at least two pixels exist in each area defined by two adjacent data lines crossing two adjacent gate lines. Each pixel is connected to the corresponding one of the gate lines G(n−1) to G(n+1) and the corresponding one of the data lines D(m) and D(m+1). In more detail, pixels disposed at both sides of one data line, i.e., disposed at two adjacent columns with respect to the one data line, are connected to the one data line. Also, among two pixels sharing the one data line and disposed on the same row, one pixel on one column of the two adjacent columns is connected to one gate line, and the other pixel on the other column of the two adjacent columns is connected to a different gate line, i.e., to a gate line next to the one gate line. In other words, two pixels sharing the same data line and the same gate line are disposed along a diagonal direction as shown by the dotted lines in FIG. 3. Therefore, the two pixels diagonally disposed are supplied with the same data voltage and constitute a pixel unit D-PXL. In FIG. 3, it is supposed that a pixel disposed at a right side of the data line D(m) and an upper side of the gate line G(n) is referred to as a first pixel s-PXL1, and a pixel disposed at a left side of the data line D(m) and a lower side of the gate line G(n) is referred to as a second pixel s-PXL2. These two pixels s-PXL1 and s-PXL2 constitute the pixel unit D-PXL.

As explained above, pixels at opposite sides of a data line share that one data line. Accordingly, a number of the data lines can be reduced by half in comparison with a number of the data lines of the related art LCD device. Further, aperture ratio and product cost can be reduced.

Each pixel includes a thin film transistor TFT, a liquid crystal capacitor Clc and a storage capacitor Cst. One electrode (pixel electrode) of the liquid crystal capacitor Clc is connected to the thin film transistor TFT, and the other electrode (common electrode) of the liquid crystal capacitor Clc is supplied with a common voltage Vcom. Although not in the drawings, the pixel electrode is disposed in each pixel on the first substrate, and the common electrode is disposed entirely on the second substrate. The pixel electrode, the common electrode, and the liquid crystal layer between the pixel and common electrodes constitute the liquid crystal capacitor Clc.

One electrode of the storage capacitor Cst is connected to the thin film transistor TFT, and the other electrode of the storage capacitor Cst is connected to a first or second storage line, which supplies a first or second storage voltage Vst1 or Vst2, respectively. For example, pixels on odd rows may be supplied with the first storage voltage Vst1, and pixels on even rows may be supplied with the second storage voltage Vst2. In FIG. 3, the storage capacitor Cst1 of the first pixel s-PXL1 is supplied with the first storage voltage Vst1, and the storage capacitor Cst2 of the second pixel s-PXL2 is supplied with the second storage voltage Vst2. Although not shown in the drawings, the first and second storage lines are disposed on the first substrate.

The common voltage Vcom determines a rotation angle of liquid crystal molecules. The first or second storage voltage Vst1 or Vst2 determines an amount of a data voltage stored in the corresponding pixel. In the present invention, not only the common voltage Vcom but also the first and second storage voltages Vst1 and Vst2 are DC voltages. By using the DC first and second storage voltages, storage line loads due to the related art AC storage voltage can be reduced. Therefore, irrespective of the positions of the pixels, the first or second storage voltage Vst1 or Vst2 is supplied uniformly to the entire pixel.

The first and second storage voltages Vst1 and Vst2 have opposite phases with respect to the common voltage Vcom. Since the first and second pixels s-PXL1 and s-PXL2 of the pixel unit D-PXL supplied with the same data voltage are supplied with the first and second storage voltages Vst1 and Vst2, respectively, a rotational angle difference of the liquid crystal molecules between the first and second pixels s-PXL1 and s-PXL2 is generated and a viewing angle can be improved.

Referring to FIG. 4 depicting an example of the common voltage Vcom and the storage voltages Vst1 and Vst2, the common voltage Vcom is supplied uniformly to the entire pixels. The first and second storage voltages Vst1 and Vst2 have opposite phases. In more detail, the first storage voltage Vst1 has a level higher than a level of the common voltage Vcom, and the second storage voltage Vst2 has a level lower than the level of the common voltage Vcom. The common voltage Vcom and the first and second storage voltages Vst1 and Vst2 may have positive polarities. For example, the common voltage Vcom may have about 5V to 6V, and the first and second storage voltages Vst1 and Vst2 may have a voltage level difference of several hundreds mV to several V in comparison with the common voltage Vcom. Levels of the first storage voltage Vst1 and the second storage voltage Vst2 may be exchanged and/or varied as needed. For example, the first storage voltage Vst1 may be below the Vcom while the second storage voltage Vst2 may be above the common voltage Vcom.

A method of driving the VA mode LCD device according to the embodiment of the present invention is explained with reference to FIGS. 3 and 4.

The common voltage Vcom is supplied to each of the pixels, and the first and second storage voltages Vst1 and Vst2 are supplied to the corresponding pixels, for example, the first and second pixels s-PXL1 and s-PXL2, respectively. The first and second storage voltages Vst1 and Vst2 have different voltage levels. The common voltage Vcom may be supplied prior to the first and second storage voltages Vst1 and Vst2.

The gate lines G(n−1) to G(n+1) are sequentially supplied with an on gate voltage. When each of the gate lines G(n−1) to G(n+1) is supplied with the on gate voltage, the thin film transistors TFT connected to that gate line supplied with the on gate voltage are turned on. For example, when the $n^{th}$ gate line G(n) is supplied with the on gate voltage, the thin film transistors TFT of the first and second pixels s-PXL1 and s-PXL2 of the pixel unit D-PXL are turned on. When the thin film transistors TFT are turned on, data voltages are supplied to the turned-on pixels through the data lines D(m) and D(m+1). For example, since the first and second pixels s-PXL1 and s-PXL2 are connected to the same gate line G(n) and the same data line D(m), the first and second pixels s-PXL1 and s-PXL2 are supplied with the same data voltage.

Figure 5:
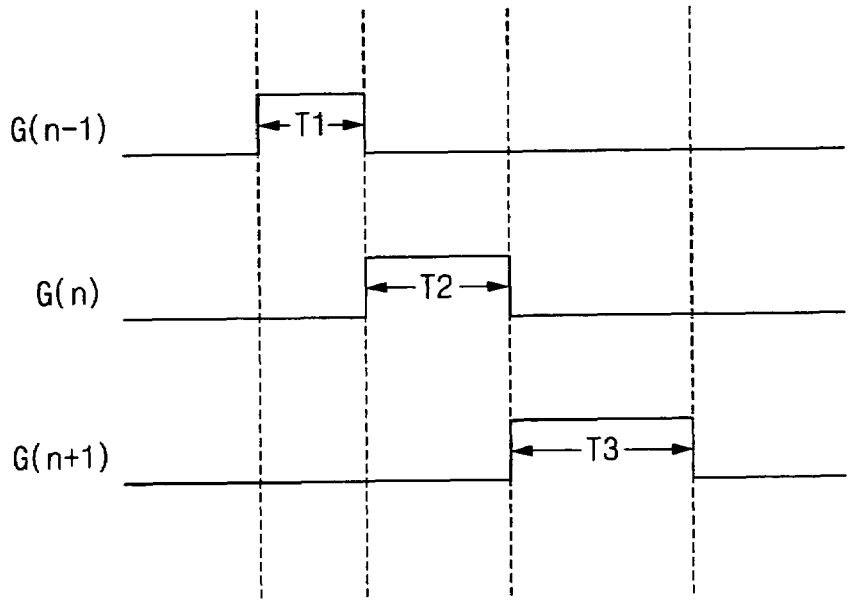
FIG. 5 is a waveform view of gate voltages supplied to gate lines of the VA mode LCD device according to another embodiment of the present invention.

FIG. 5 is an example of a waveform view of gate voltages supplied to the gate lines of a VA mode LCD device according to another embodiment of the present invention. These gate voltages are applied to the LCD device of FIG. 3, but can be applied to other display devices.

As shown in FIG. 5, when the gate lines G(n−1) to G(n+1) are sequentially scanned, on gate voltage times (high level times) T1 to T3 of gate voltages supplied to the corresponding gate lines G(n−1) to G(n+1) increase (T1<T2<T3) as the designation number of the gate line increases. A level of a data voltage is reduced as a position of a data line is further away from a data driving IC supplying the data voltage, because the data line has a resistance load and a capacitance load. The on gate voltage time (T1 to T3) increases according to the positions of the pixels so that a time sufficient to store the data voltage is given to the pixels, whereby the data voltage is properly supplied to the pixels. Therefore, loss of the data voltage due to the data line loads and loss of the data voltage stored in the pixels can be minimized.

As explained above, the first and second pixels of a pixel unit supplied with the same data voltage and the same gate voltage are supplied with the first and second storage voltages having different levels, respectively. The first and second storage voltages for each pixel unit are DC voltages. Accordingly, all the pixels can be normally operated, and a wide viewing angle and a high display quality can be achieved.

It will be apparent to those skilled in the art that various modifications and variations can be made in the liquid crystal display device and the method of driving the liquid crystal display device of the present invention without departing from the spirit or scope of the invention. Thus, it is intended that the present invention cover the modifications and variations of this invention provided they come within the scope of the appended claims and their equivalents.

What is claimed is:

1. A liquid crystal display device, comprising:

a plurality of data lines and a plurality of gate lines crossing each other;

a first pixel connected to one of the plurality of data lines and to one of the plurality of gate lines; and a second pixel connected to said one of the plurality of data lines and to said one of the plurality of gate lines, wherein the first and second pixels are disposed at opposite sides with respect to said one of the plurality of data lines and at opposite sides with respect to said one of the plurality of gate lines, and wherein a liquid crystal capacitor of the first pixel and a liquid crystal capacitor of the second pixel are simultaneously supplied with the same data voltage when said one of the plurality of gate lines is supplied with an on gate voltage.

2. The device according to claim 1, wherein each of the first and second pixels includes:

a thin film transistor connected to said one of the plurality of data lines and said one of the plurality of gate lines, the liquid crystal capacitor connected to the thin film transistor and supplied with a common voltage, and a storage capacitor connected to the thin film transistor and supplied with a first or second storage voltage.

3. The device according to claim 2, wherein the storage capacitor of the first pixel and the storage capacitor of the second pixel are supplied respectively with the first and second storage voltages.

4. The device according to claim 3, wherein the common voltage and the first and second storage voltages are DC voltages.

5. The device according to claim 4, wherein a level of the common voltage is between levels of the first and second storage voltages.

6. The device according to claim 1, wherein the liquid crystal display device is a vertical alignment mode liquid crystal display device.

7. The device according to claim 1, wherein each of the gate lines is supplied with an on gate voltage, and durations of the on gate voltages are different from each other.

8. The device according to claim 7, where the durations of the on gate voltages increase as a designation number of the gate lines increases.

9. A method for forming a liquid crystal display device, comprising:

forming a plurality of data lines and a plurality of gate lines crossing each other on a substrate;

forming a first pixel connected to one of the plurality of data lines and to one of the plurality of gate lines; and forming a second pixel connected to said one of the plurality of data lines and to said one of the plurality of gate lines, wherein the first and second pixels are disposed at opposite sides with respect to said one of the plurality of data lines and at opposite sides with respect to said one of the plurality of gate lines, and wherein a liquid crystal capacitor of the first pixel and a liquid crystal capacitor of the second pixel are simultaneously supplied with the same data voltage when said one of the plurality of gate lines is supplied with an on gate voltage.

10. The method according to claim 9, wherein DC storage voltages are supplied to storage capacitors of the first and second pixels.

11. A method of driving a liquid crystal display device, comprising:

sequentially supplying an on gate voltage to a plurality of gate lines;

supplying a plurality of data voltages to a plurality of data lines, respectively;

supplying first and second storage voltages to first and second pixels, respectively, the first and second storage voltages being DC voltages; and supplying a common voltage to the first and second pixels, wherein the first pixel is connected to one of the plurality of data lines and one of the plurality of gate lines, and the second pixel is connected to said one of the plurality of data lines and said one of the plurality of gate lines, wherein the first and second pixels are disposed at opposite sides with respect to said one of the plurality of data lines and at opposite sides with respect to said one of the plurality of gate lines, and wherein a liquid crystal capacitor of the first pixel and a liquid crystal capacitor of the second pixel are simultaneously supplied with the same data voltage when said one of the plurality of gate lines is supplied with the on gate voltage.

12. The method according to claim 11, wherein each of the first and second pixels includes:

a thin film transistor connected to said one of the plurality of data lines and said one of the plurality of gate lines, the liquid crystal capacitor connected to the thin film transistor and supplied with the common voltage, and a storage capacitor connected to the thin film transistor and supplied with the first or second storage voltage.

13. The method according to claim 11, wherein a level of the common voltage is between levels of the first and second storage voltages.

14. The method according to claim 11, wherein the common voltage and the first and second storage voltages have positive polarities.

15. The method according to claim 11, where the durations of the on gate voltages increase as a designation number of the gate lines increases.

16. A liquid crystal display device, comprising:

a plurality of data lines and a plurality of gate lines crossing each other; and a plurality of at least two pixels which include first and second pixels forming a pixel unit, the first and second pixels disposed at opposite sides with respect to one of the plurality of data lines and at opposite sides with respect to one of the plurality of gate lines, each of the pixels including a storage capacitor, wherein each of the pixels is supplied with a common voltage, each of the storage capacitors is supplied with a first or second storage voltage, and the common voltage and the first and second storage voltages are DC voltages, wherein the first pixel is connected to said one of the plurality of data lines and said one of the plurality of gate lines, and the second pixel is connected to said one of the plurality of data lines and said one of the plurality of gate lines, and wherein a liquid crystal capacitor of the first pixel and a liquid crystal capacitor of the second pixel are simultaneously supplied with the same data voltage when said one of the plurality of gate lines is supplied with an on gate voltage.

17. The device according to claim 16, wherein the device is a vertical alignment mode liquid crystal display device.

18. The device according to claim 16, wherein each of the gate lines is supplied with an on gate voltage, and durations of the on gate voltages are different from each other.

19. The device according to claim 18, where the durations of the on gate voltages increase as a designation number of the gate lines increases.

* * * * *